United States Patent [19]

Schaller

[11] Patent Number: 4,643,508

[45] Date of Patent: Feb. 17, 1987

[54] DIRECTION-SENSITIVE SENSOR

[75] Inventor: Werner Schaller, Lampertheim, Fed. Rep. of Germany

[73] Assignee: Siemens Aktiengesellschaft, Munich, Fed. Rep. of Germany

[21] Appl. No.: 463,046

[22] Filed: Feb. 1, 1983

[30] Foreign Application Priority Data

Feb. 3, 1982 [DE] Fed. Rep. of Germany ..... 3203520

[51] Int. Cl.[4] ..... H01R 3/00

[52] U.S. Cl. ..... 339/147 R; 339/7; 339/94 M

[58] Field of Search ..... 339/7, 8, 5, 6, 92 M, 339/92 R, 147 R, 94 R, 94 M; 338/73, 62, 174; 33/1 PT; 73/1 E

[56] References Cited

U.S. PATENT DOCUMENTS 958,448 5/1910 Vossberg ..... 339/8 R 1,591,791 7/1926 Sprout ..... 339/7

FOREIGN PATENT DOCUMENTS 2130022 11/1972 Fed. Rep. of Germany .

*Primary Examiner*—Eugene F. Desmond

*Attorney, Agent, or Firm*—Kenyon & Kenyon

[57] ABSTRACT

A direction-sensitive sensor of the type which is particularly useful as a proximity sensor, is provided with a sensor part which is rotatively connected to a further sensor part via a rotary joint consisting of a bracket connection. The sensor parts are rotatably mounted about an axis which is perpendicular to the joint axis in the desired rotation angle position in a holder. Electrical connecting elements are designed as circular rings or segments of circular rings which are arranged concentric about the joint axis and are firmly connected to the connecting brackets. At least one of the brackets is provided with a sealing element which seals out the environment. In this manner, a moisture-proof and electrically highly conductive connection is achieved between the sensor portions. Moreover, the sensor portions can be arranged in any desired angular position while maintaining a good seal which prevents the environment from affecting the connection.

23 Claims, 44 Drawing Figures

DIRECTION-SENSITIVE SENSOR

BACKGROUND OF THE INVENTION

This invention relates generally to direction-sensitive sensors, and more particularly, to a proximity sensor having first and second sensor portions which are connected to one another via a swivel joint; the sensor portions being held by a holder in a position corresponding to a desired angle of rotation about a further axis which is perpendicular to the axis of the swivel joint. The sensor portions are coupled electrically to one another via connecting elements.

A known switching sensor arrangement which operates without contact and is of the type noted hereinabove is described in German reference DE-AS No. 2 130 022. In the known arrangement, the adjustability of the sensor head is achieved within relatively wide limits, and electrical connections are provided via cables from a sensor head to a signal output portion. The cable in the known arrangement may be damaged when the sensor is turned, and the replacement of the sensor head is not easily accomplished. Moreover, an expensive arrangement is required in the known system to render the wire connection, particularly where the wire enters into the sensor head, moisture proof and protected against external influences.

It is, therefore, an object of this invention to provide a direction-sensitive, inexpensive sensor arrangement of relatively simple design.

It is a further object of this invention to provide a direction-sensitive sensor arrangement wherein its various parts are easily replaceable.

It is a still further object of this invention to provide a direction-sensitive sensor arrangement in which a sensor head portion and a signal output portion can be joined to one another in a hinge-like manner so as to be electrically coupled in a moisture-proof manner without the use of wire connections.

SUMMARY OF THE INVENTION

The foregoing and other objects are achieved by this invention which provides electrically connecting elements designed as circular rings, or segments of circular rings, which are arranged concentrically about the axis of the joint. The electrically connecting elements are firmly connected to joint brackets, at least one of the brackets having a sealing element which encloses the circular rings or circular ring segments. In this manner, the sensor head can be rotated about its effective directional axis relative to the signal output portion into any desired angular position for which contact can be made.

Although proximity switches of the type wherein a connection between a control unit and an initiator module is achieved via sliding contacts are known, such interconnection is achieved by means of sliding contact springs which are held at the control unit and which cooperate with sliding contact strips at the initiator module. In addition to unpredictable contact pressures applied by means of a known contact rivet, which is generally only a point contact, external influences resulting from environmental conditions are unavoidable because essentially no measures are taken illustratively with respect to sealing against the penetration of moisture. This is compounded by the fact that the known arrangement contains a considerable air volume in order to accommodate the electrical connection elements. This volume would have to be kept tightly closed against variations in air pressure because such air pressure fluctuations would permit entry of moisture and condensate of water, which can lead to corrosion, short circuits and unreliable contacts. In this invention, since the electrical connecting elements for both sensor portions are constructed in the form of circular washers, or circular washer elements, a very flat arrangement of the contact system is achieved whereby the air volume in the interior of the contact chamber formed by the connecting brackets and the sealing element is kept very small, thereby preventing breathing of the volume of air in the contact chamber.

In this invention, the connecting brackets with their inserted circular washers, or circular washer segments, for making electrical contact, and the sealing elements which enclose them, can be made compatible for different sensor heads and signal output portions. Thus, the invention enables the combination of different sensor heads with different signal output portions. If the electrical connecting element is are entirely, or partially, part of the etched or printed circuit boards which are integrated into the respective bracket areas and carry the electrical components, no separate contact elements need be placed thereon. The circular rings, or ring segments, can be made simultaneously with the etching of the circuit board without additional effort, and the volume of the contact chamber can be maintained quite small. In this regard, it is advantageous if the electrical connecting elements are formed together with the conductor runs of the circuit boards using the same technology, and preferably etched from a copper laminate.

It is a significant advantage of this invention that during production the connecting elements and the soft-elastic sealing elements can be integrated into the sensor parts in a single operation. Both sensor parts have an integral foam encapsulation which forms the outside surface and encloses the electronic circuit. The encapsulation is preferably made of synthetic polyurethane (PU) resin. The seal which encloses the electrical connecting elements against the environment is integrated in the surface of at least one of the two sensor parts. The electrical connecting elements of the signal output part or the sensor head protrude from the surface of the integral foam by a height which corresponds to that of the compressed seal. In this manner, it is assured that the area pressure required for a proper seal is obtained in the soft elastic seal. Moreover, possible damage to the seal by excessive deformation is prevented by providing that the electrical contact elements limit the deformation motion exerted on the seal upon mutual contact of such elements, thereby achieving an optimum pressure for the seal. Thus, the pressure at the contact surfaces of the electrical connecting elements can be brought to the high value which is required for achieving reliable, permanent contact, without influencing the sealing conditions.

An even flatter design of the contact system is possible in the region of the swivel joint if the electrical connecting elements are connected by means of through-connected, (plated) conductor run outputs to the conductor runs of the circuit on the opposite side of the circuit board. This is achieved in such a manner that no conductor runs cross the area of the sealing elements on the contact side of the connecting elements. Since no conductor runs cross the area of the sealing elements on the contact side of the connecting elements, it is possible to cement on one or possibly both circuit board parts which carry electrical connecting elements, thin sealing elements. The thin sealing elements surround the electrical connecting elements and keep, when the contact system which formed by etching both circuit boards is compressed, a residual height of elasticity which corresponds at all points in the contact area of the seal to the sum of the metal layer thicknesses of both circuit boards.

An improvement of the adhesive bond made by means of integral foam between the circuit board surface and the soft elastic seal can be achieved in the region in which the circuit board undercuts the seal because at least one of the circuit boards of the two sensor parts is designed as a flexible circuit board. Moreover, this improvement is achieved because the conductor runs of the circuit and the electrical connecting elements lie on a section of the circuit board which is offset toward the contact side of the bracket and which is embedded in the integral foam encapsulation, except for the region of the electrical connecting elements. In addition, the adhesive bond is improved because the circuit boards are surrounded by the sealing elements.

In one embodiment of the invention, it is advantageous to structure the arrangement such that one of the sensor portions carries two connecting brackets in a fork-like arrangement of the type where a single mating bracket of the complementing sensor portion is inserted between the fork brackets. In this manner, the cross section of the seal can be freely formed as to size, as well as mechanical design, without the need to give up the advantages of the flat contact chamber and the use of printed circuit boards. In such an arrangement, it is possible to use a circuit board which is covered with conductor runs on only one side without through-plated connector holes, if each of the two sensor portions carries two or more connecting brackets with electrical connecting and sealing elements. Moreover, it is also possible to achieve an increase in the number of electrical connections between the sensor head and the signal output portion. It is a further advantage of this invention that circular rings may be provided on both sides which are connected to achieve the desired sensor function if special sensor heads are used. It is a still further advantage, in embodiments where the connecting brackets of one sensor portion engage with circular roundings in corresponding circular recesses of the other sensor portion, that the engagement can be achieved in such a manner that the sensor portions produce an exterior configuration which corresponds to concentric cylinders having a joint axis, in any position of the tilt angle. In this manner, the sensor can be adjusted continuously without the need to disassemble the device. Thus, an esthetically pleasing appearance of the sensor is achieved.

In a further embodiment of the invention, a clamping element is provided which connects the sensor portions to one another near the center of the joint axis in a form-locking manner. The clamping element is surrounded by an inner sealing element at the point of contact between the brackets for sealing the connecting elements in an inward direction. The inner sealing element is formed of an elastic material which is formed by the elastic integral foam encapsulation. In this simple manner, the invention achieves a desired contact pressure which is necessary for making electrical contact and for sealing. The use of an inner sealing element saves sealing the clamping element as the contact surfaces of the connecting brackets.

This arrangement also achieves cost savings in production because the inner seal is produced at the same time when the internal sensor parts are foamed in the foam mold. In one particularly advantageous embodiment of the invention, the clamping element is formed of a clamping screw, or a clamping bolt, and is provided with a spring element which is braced against the bracket connection. In this manner, the maintainance of the contact pressure for the electrical connecting elements, and the sealing, is ensured in a simple manner over an extended period of time. In such an arrangement, it is possible to use an elastic material which is not soft, illustratively, plane seal, if the housing which encloses the internal parts of the sensor must be formed of a special material, such as chemically resistant rigid material. The electrical contact elements in the interior of the sensor can be embedded in a soft elastic material, illustratively PU integral foam.

In a simple, cost-saving embodiment of the invention, a coil spring is inserted into the center of the joint axis, and one end of the spring is provided with an enlarged diameter. The resulting spring head rests in one of the outer brackets, preferably in a depression, and the other end of the spring is screwed into a bore having a corresponding thread pitch in the other outer bracket. A further improvement in the joint axis and clamping system is achieved by providing a coil spring having one end of the spring wire thereof placed in the joint axis as a chord across the diameter, and bent back in a fork fashion to form a screwdriver slot. The formation of a screwdriver slot at the head end of the coil spring joint axis permits a particularly simplified arrangement for unscrewing the spring from a right-hand thread, while a screwdriver slot at the other spring end facilitates right-handed screwing-in.

The incorporation of a replaceable joint system between the two sensor portions, particularly the sensor head and the signal output portion in a cylindrical sensor enables a sensor of standard dimensions to be designed. For example, such a design may be in accordance with the European Standard and can be employed accordingly. However, such an arrangement provides the additional advantages of providing adjustable directional sensitivity, thereby enabling sensor heads and signal output portions having different physical properties to be combined, and permitting the technical data for the sensitive portion and the signal output portion to be standardized. Thus, a relatively small number of individual units can be combined to produce a multiplicity of sensor designs, thereby requiring only a small inventory to be maintained. These advantages are achieved particularly if the diameter of the circular recesses and roundings is selected to be of the same size as the diameter of the sensor portions, in the area of the joint where the sensor portions are cylindrical, and if the sensor portions are provided on at least one side with wedge-shaped cuts. Such cuts change the circular outline of the rounding and the recess, and the wedge surfaces of the wedge-shaped cuts lie on top of each other in an angled-off orientation of the sensor portions. In the extended condition of the sensor, the external contour which is customary for normal cylinder sensors is maintained. The wedge-shaped cuts occupy less than one quarter of the circumference of the outer cylindrical surface of the sensor. As a result of the slight change in the outside surface of the cylinder, the application of a screw-in thread, such as is provided for certain standardized sensors, remains possible without adversely affecting the function of the thread. However, a relatively sharp bend of the two sensor portions with respect to each other by 90 degrees is possible. Moreover, by placing a threaded nut at the outer surface over the joint connections, the two sensor portions are rigidly held with respect to each other. A separate joint shaft can be saved while maintaining a good seal if a profiled sealing ring is arranged as the sealing element concentrically about the joint axis. The sealing ring protrudes from the surface of the connecting bracket which engages a correspondingly designed profiled sealing slot in the connecting bracket in the other sensor portion.

In order to maintain the force which must be applied in the direction of the joint axis to maintain a small contact pressure at the seal, it is advantageous if the profile sealing ring has a wedge-shaped profile with straight or curved inclined surfaces at the opposite profile sealing slot This arrangement is provided with a profile having a narrowed cross-section which takes into consideration the deformation of the seal. The installation of a specially made seal can be eliminated if the profile sealing ring of the one connecting bracket, and the profiled sealing slot of the other connecting bracket, are integrally formed of PU foam which encloses the circuit and confines the connecting brackets. In this arrangement, at least one of the two sealing elements is made of elastic integral PU foam. The seal is formed in the same operation without additional effort when the sensor encapsulation is made.

A cost-effect manufacturing process for the sensor is assured if the profile sealing ring and the profile sealing slot have an undercut, dovetail-like profile, and if, through the snap-in engagement of these parts, the swivel joint connection and the contact pressure device of the connecting brackets if the dovetail profile is integrated into a soft elastic PU integral foam encapsulation. This results from the fact that neither a separately made joint axis nor a special contact pressure device for the electrical contacting elements which consist of either circular rings or circular ring elements, is necessary.

The seal in the region of the joint axis can be further improved in a simple manner by providing in the vicinity of the undercut resilient lips for the profile sealing ring. The resilient lips are arranged to extend beyond the contours of the profiled sealing slot and are deformed elastically in the snap-in engagement. The lips, therefore, rest in the snap-in position with pretension against the undercut portion of the profiled sealing slot and thereby generate the contact pressure for the electrical connecting elements and for the seal. The contact pressure system for the connecting elements can be integrated in a simple manner into the integral PU foam encapsulation if an inwardly pretensioned, preferably flat, fork spring is embedded into the outer connecting brackets of the fork system. Additional fastened bolts in the center of the joint axis can be omitted if a conical rise is formed in the center of the joint axis on at least one connecting bracket. The conical rise engages a depression in the other connecting bracket in a form-locking manner.

As noted, the present inventive sensor can be used instead of standard cylindrical sensors having screw attachments on the outside, especially if both sensor portions are provided on the outside with a thread of the same size. In general, a sensor head must be adapted to special requirements, illustratively a capacitive, inductive, or optical sensor head, or a sensor head which utilizes one of several other physical phenomena. Accordingly, it is advantageous to divide the sensor portions from the output portions.

BRIEF DESCRIPTION OF THE DRAWINGS

Comprehension of the invention is facilitated by reading the following detailed description in conjunction with the annexed drawings, in which.

DETAILED DESCRIPTION

Figure 4:
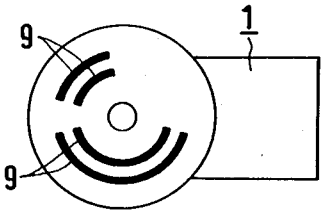
FIG. 4 is a plan view of a sensor portion showing electrical connecting elements in the form of circular ring elements.
Figure 2:
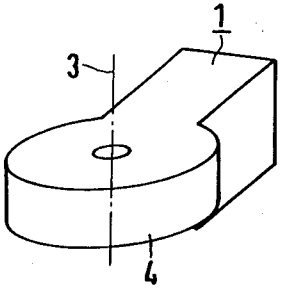
FIG. 2 is an isometric, exploded view of the sensor arrangement of FIG. 1.
Figure 2:
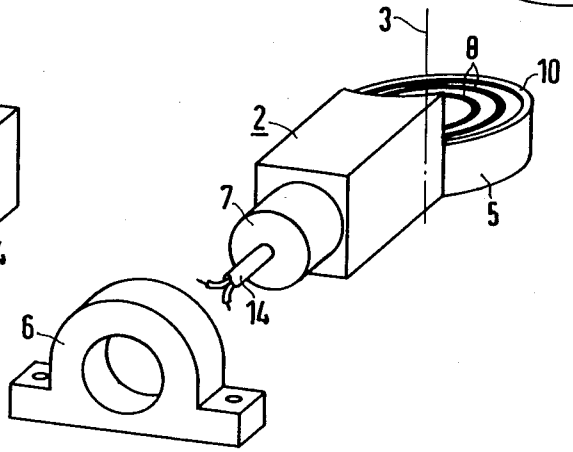
Figure 3:
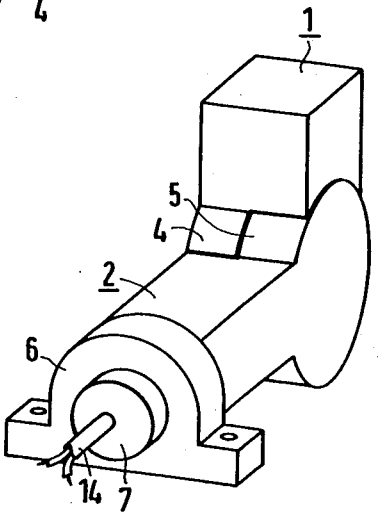
FIG. 3 is an isometric view of the embodiment of FIG. 1 which has been bent 90 degrees about a joint axis and a clamping axis.
Figure 1:
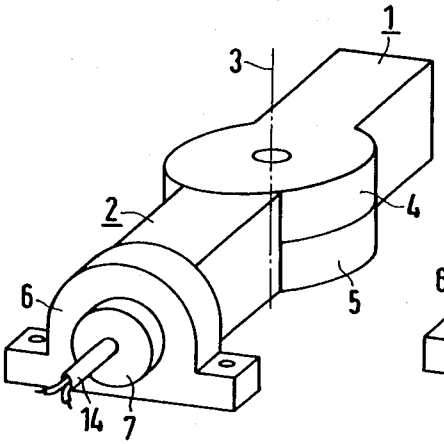
FIG. 1 is an isometric representation of a sensor arrangement constructed in accordance with the principles of the invention wherein the sensor portions are each provided with a connecting bracket.

The figures show various embodiments of sensor arrangements having sensor portions 1 and 2. Generally, sensor portion 1 corresponds to a sensor head, and sensor portion 2 corresponds to a signal output portion of the sensor arrangement. Sensor portions 1 and 2 swivel about one another at a swivel joint having an axis 3. The coupling between the sensor portions is achieved by means of a connecting bracket 4 on sensor portion 1, and a connecting bracket 5, at sensor portion 2.

In addition to the hinged interconnection at joint axis 3, the sensor arrangement is rotatably supported about its longitudinal axis (not shown) in a holder 6. The sensor arrangement is held in any desired angular position by clamping cylindrical journal 7 to holder 6. The electrical connecting elements consist of circular rings 8 and circular ring segments 9, respectively, which are firmly connected to the coupling brackets 4 and 5. Rings 8 and ring segments 9 are concentric with respect to joint axis 3 and, when the sensor portions are coupled to one another, the rings and ring portions are protected from the environment by an elastic sealing element 10. Circuit rings 8 are part of circuit board 11. Such rings may, for example, be etched together with other conductor runs 12 from circuit board 7. Circuit board 13 in sensor head 1 contains circular ring segments 9, and the conductor runs 12 are similarly made. The signal output portion 2 is provided with a cable 14 for enabling connections thereto, cable 14 being brought through holder 6 and coupled to corresponding terminals (not shown).

Figure 5:
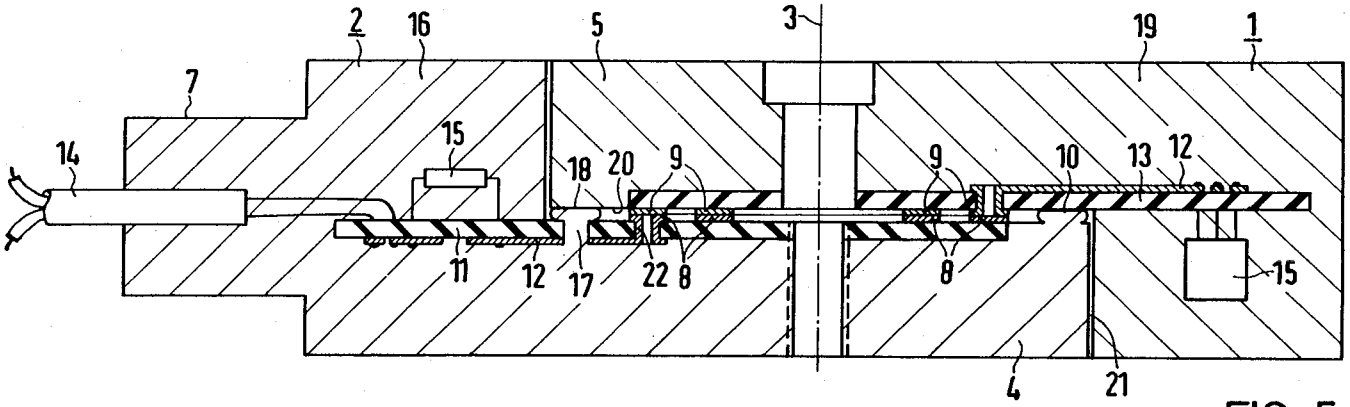
FIG. 5 is a longitudinal cross-sectional representation of the embodiment of FIG. 1.
Figure 9:
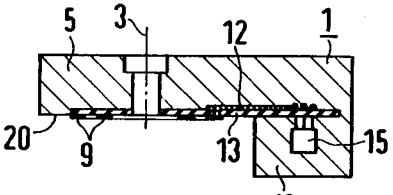
FIGS. 8 and 9 are top plan and longitudinal cross-sectional views, respectively, of the embodiment of FIGS. 1–5.
Figure 8:
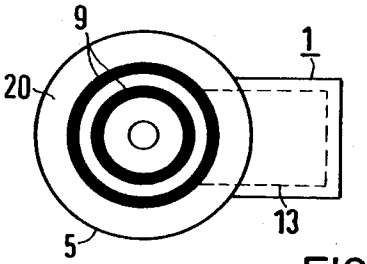
Figure 6:
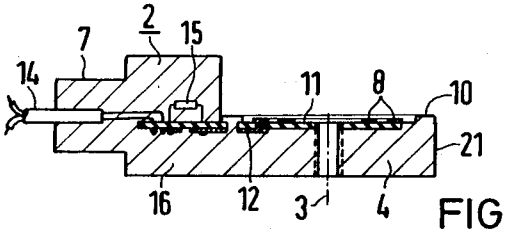
FIG. 6 is a cross-sectional representation of a signal output portion of a sensor arrangement.
Figure 7:
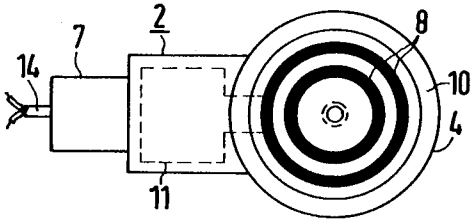
FIG. 7 is a top plan view of the embodiment of FIG. 6 showing the electrical connecting elements arranged in the form of circular rings, and a sealing element surrounding the rings.
Figure 10:
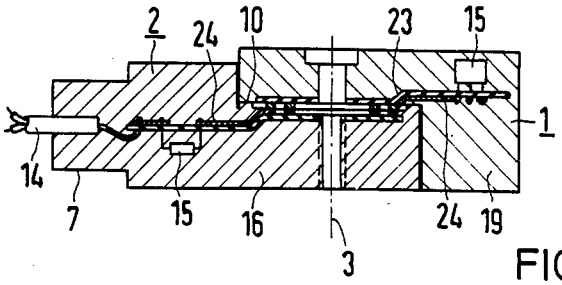
FIG. 10–14 are longitudinal cross-sectional, fragmented top plan, and top plan views of the embodiments shown in FIG. 5–9, the sensor arrangement having a flexible conductor foil set back in the vicinity of the seal.
Figure 11:
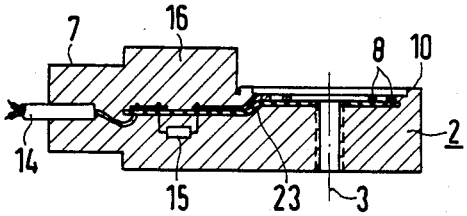
Figure 14:
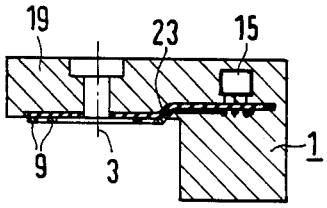

As shown in FIGS. 5–7, electronic components 15, which are mounted on circuit boards 11 and 12 are held in signal output portion 2, illustratively in an integral foam encapsulation 16. At least one support bridge 17 is arranged in a region 18 of sealing element 10 so as to extend through circuit board 11. In this manner, sealing element 10 is held by the integral foam which surrounds components 15. In one embodiment, the sealing element is formed of elastic integral foam and forms a unit therewith via bridge 17. Moreover, the sealing element is formed in one and the same process with the encapsulation.

Components 15 are also provided with an integral foam encapsulation in sensor head portion 1. In contrast to the encapsualtion of signal output portion 2, no sealing element is formed in sensor portion 2. In this embodiment, the surface of the integral foam encapsulation is made smooth on sensor portion 2 so that it may rest tightly against sealing element 10.

A surface 21 of signal output portion 2 can also be made hard by a suitable foaming process so that it is therefore not necessary to encapsulate the signal output portion with additional housing parts. Circuit boards 11 are held by the integral foam, and conductor runs 12, on the underside of circuit boards 11, are connected to one another by through-connected conductor run leads 22. FIG. 5 clearly illustrates the contact of sealing element 10 with the smooth surface 20 of sensor portion 1. The figure further shows the contact of circular rings 8 of sensor portion 2 with circular ring elements 9 of sensor portion 1.

Figure 12:
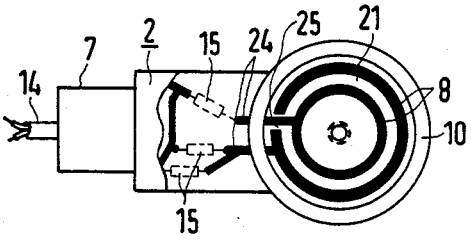
Figure 13:
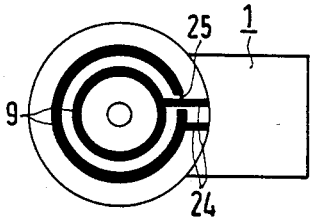

FIGS. 10–13 show an embodiment of the invention which does not require any bridges, such as bridge 17 discussed hereinabove, which must pass through conductor runs 12 and circuit board 11. The circuit board is offset in an offset region 23 which is in the vicinity of sealing element 21. In this manner, a sufficient amount of integral foam is available above the circuit board for forming sealing element 10. A particularly advantageous manner of creating the offset utilizes a thin flexible circuit board. FIGS. 12 and 13 show that conductor run leads 24 can be arranged without adversely affecting sealing element 10. Moreover, an interruption 25 can be provided in the outer one of circular rings 8.

Figure 16:
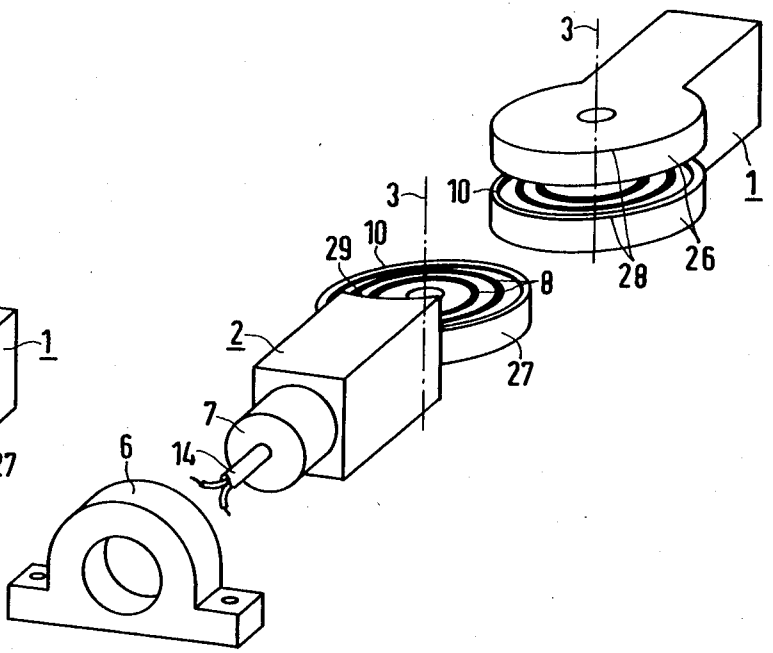
FIG. 16 is an isometric, exploded view of the embodiment of FIG. 15.
Figure 15:
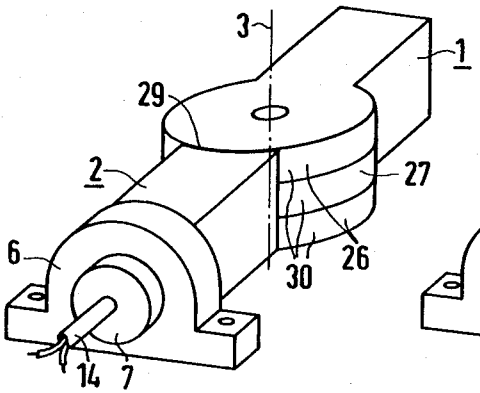
FIG. 15 shows an isometric representation of a sensor arrangement having connecting elements designed in fork-fashion at a sensor portion.

In accordance with FIGS. 15 and 16, sensor head 1 is provided with two connecting brackets 26 in a fork-like arrangement. The brackets extend around a single connecting bracket 27 which is a part of sensor head portion 2. This arrangement provides more space for establishing electrical connections without the need for increasing the volume of the sensor. It has further been found to be advantageous to provide connecting brackets 26 and 27 with a circular rounding 28 which corresponds with a circular recess 29 in sensor portion 2. Such roundings and recesses may be incorporated into the other embodiments of the invention, discussed hereinabove. Assembled connecting brackets 26, 27, 4, and 5 form a joint cylinder 30.

Figure 18:
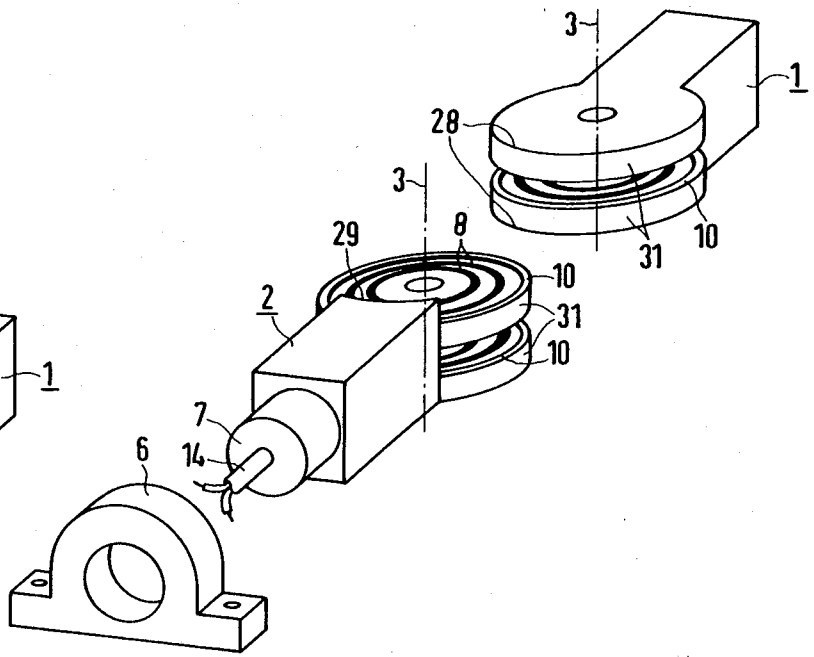
FIG. 18 is an exploded perspective view of the embodiment of FIG. 17.
Figure 17:
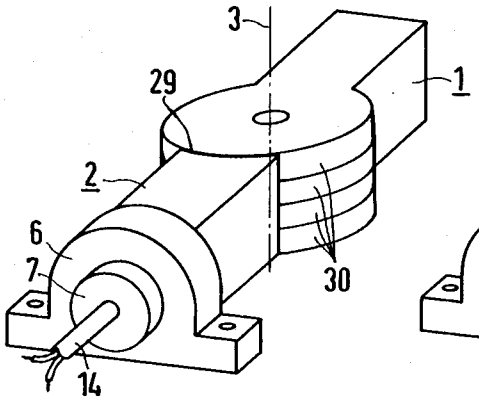
FIG. 17 is an isometric view of a sensor arrangement constructed in accordance with the principles of the invention wherein both sensor portions are designed in fork-like fashion in the load region of the connection.

FIGS. 17 and 18 illustrates an embodiment of the invention wherein sensor head portion 1 and signal output portion 2 each contain multiple connecting brackets 31. In this embodiment, the joining of sensor portions 1 and 2 by the interleaving of their respective brackets, as shown in FIG. 17, forms a joint cylinder 30.

Figure 19:
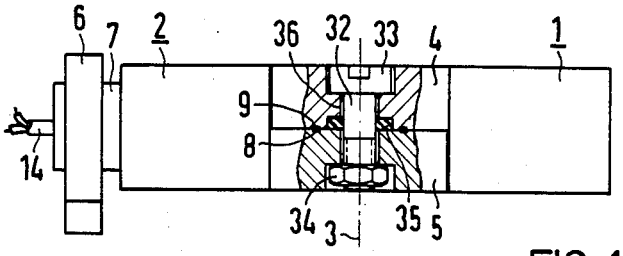
FIGS. 19–21 are partially cross-sectioned longitudinal views of a swivel joint formed between the sensor portions, FIG. 19 showing a screw connection with a nut, FIG. 20 showing a screw connection with internal thread in one sensor portion, and FIG. 21 showing a connection via a cup spring and clamping bolt.

FIG. 19 illustrates that a joint axis can be formed by a standard machine screw 32 having a head 33 which rests on sensor portion 1, and which is tightened by a nut 34 which rests against signal output portion 2. An internal sealing element 35 seals the two sensor portions in the area of the clamping element. As shown in the figure, clamping screw 32 penetrates through both sensor portions via a hole 36.

Figure 20:
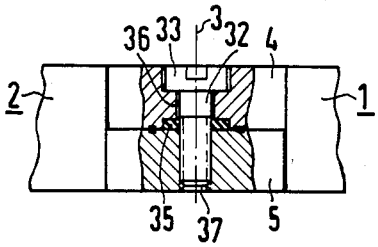
Figure 21:
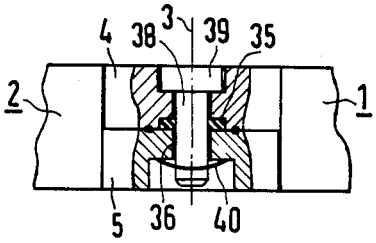
Figure 22:
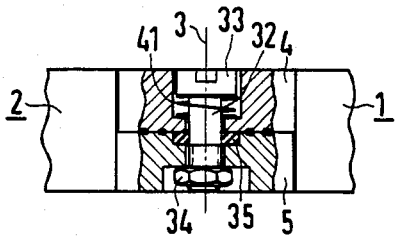
FIG. 22 is a partially cross-sectioned longitudinal view of the embodiment of FIG. 19 having an inserted coil spring.
Figure 23:
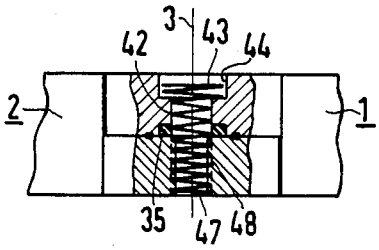
FIG. 23 is a partially cross-sectioned longitudinal view of an embodiment of the invention having a coil spring connection.
Figure 24:
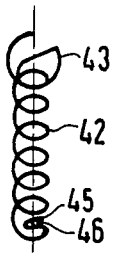
FIG. 24 illustrates the design of the spring incorporated into the embodiment of FIG. 23.
Figure 25:
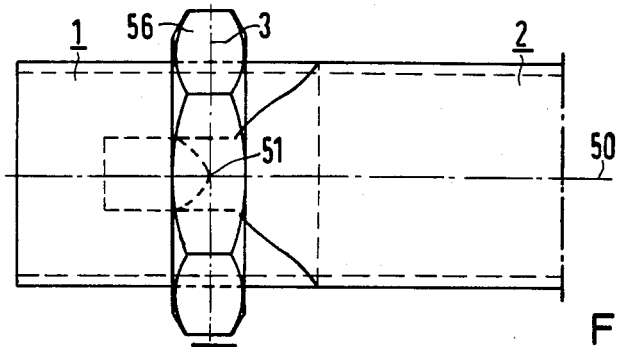
FIGS. 25–27 show front, side, and rear views of a connecting point of sensor portions of a cylindrical sensor having a wedge-shaped cutout.

FIG. 20 shows an embodiment of the invention wherein a tapped hole 37 is arranged in sensor portion 2, and replaces nut 34. In this embodiment, it is also possible to achieve the connection by means of a clamping bolt 38, as shown in FIG. 21. Thus, the head of clamping bolt 39 is disposed in the depression in sensor portion 1, instead of head 33 shown in FIG. 19. FIG. 21 shows a cup-spring 40 having a cross slot as the clamping element which takes the place of nut 34. In FIG. 22, an elastic connection is achieved by inserting a coil spring 41. FIG. 23 shows a coil spring 42 used as the joint axis. A spring head 43 of the coil spring is placed in depression 44 in sensor portion 1. As shown in FIG. 24, the spring wire is bent back at an end 45 so as to form a chord across the diameter of the coil spring. In this manner, a screwdriver slot 46 is produced. The thread end 47 of coil spring 42 can be screwed into thread 48 in a connecting bracket, as shown in FIG. 23.

Figure 26:
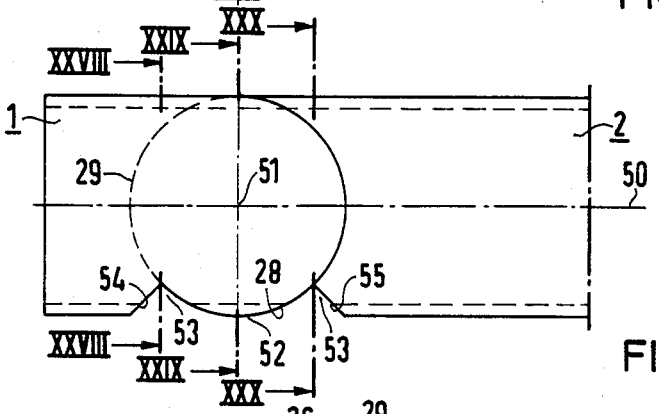
Figure 27:
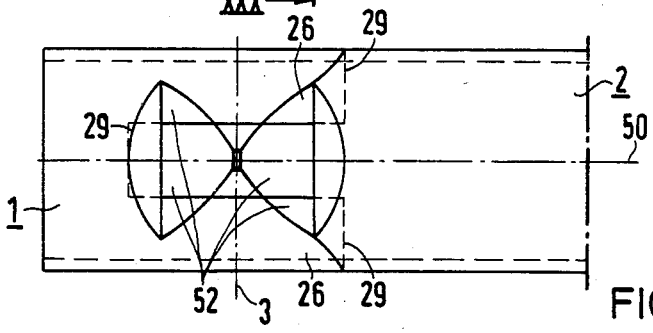
Figure 28:
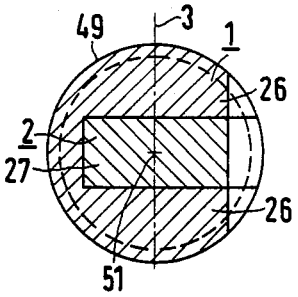
FIG. 28 shows a cross-sectional view of the embodiment of FIG. 26 taken along line XXVIII.
Figure 29:
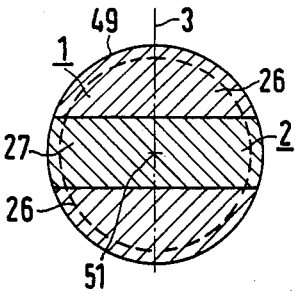
FIG. 29 shows a cross-sectional view of the embodiment of FIG. 26 taken along line XXIX.
Figure 30:
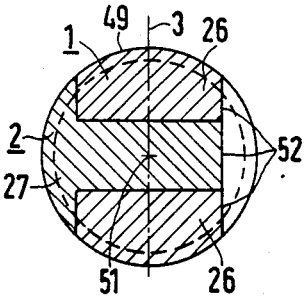
FIG. 30 shows a cross-sectional representation of the embodiment of FIG. 26 taken along line XXX.
Figure 31:
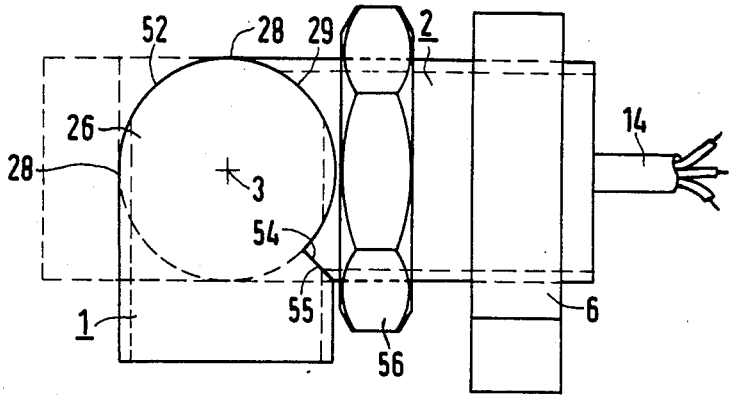
FIGS. 31–33 show respective views of a sensor arrangement according to FIG. 25–30, the sensor portions being arranged at 90 degrees with respect to one another.
Figure 32:
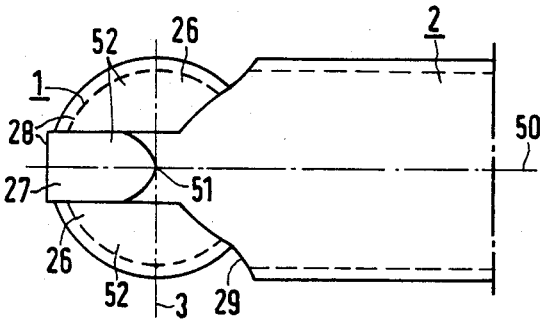
Figure 33:
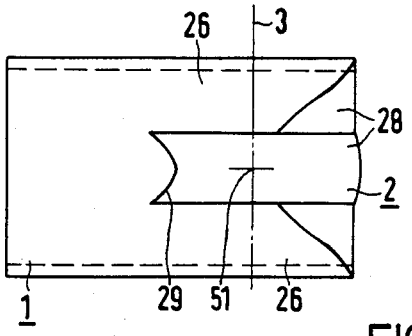
Figure 34:
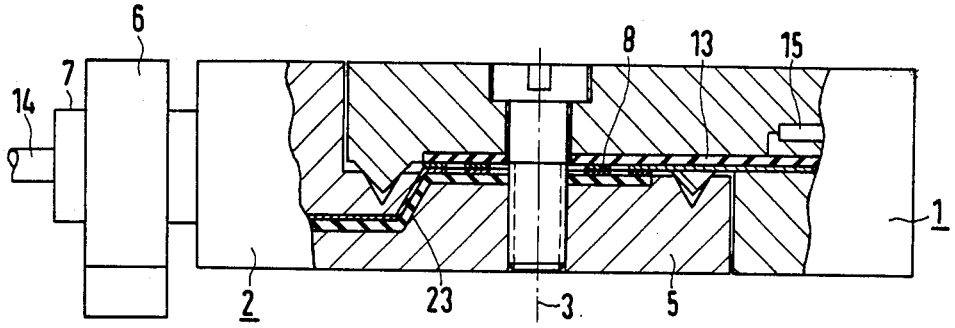
FIG. 34 is a partially cross-sectioned longitudinal view of a sensor arrangement constructed in accordance with the principles of the invention having a profiled sealing ring which is fastened to a sensor portion and which engages a correspondingly designed profiled sealing slot in the other sensor portion.
Figure 35:
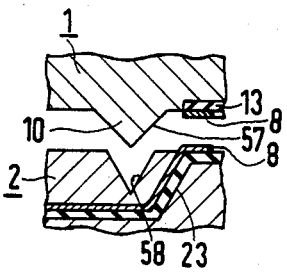
FIGS. 35–37 show different profile shapes wherein the respective sensor portions are separated from one another.

FIGS. 25–33 illustrate a special embodiment of the invention having a cylindrical outer shell 49 on which preferably a thread is cut. Sensor head portion 1 has fork-shaped connecting brackets 26 which engage single connecting bracket 27. The intersection of the joint axis 3 with the longitudinal axis 50 for the sensor arrangement is designated as 51. The outside contours of the two brackets are designated 52. As shown in FIG. 26, a wedge-shaped cut 53 is provided on both sides of joint axis 3 so as to permit sensor head 1 to swing away from signal output portion 2 by 90 degrees. In this embodiment, wedge surfaces 54 of sensor head 1 rests against wedge surfaces 55 of signal output portion 2, as shown in FIG. 31. It is sufficient to provide the wedge-shaped cuts 53 only on one side of the sensor, since the 90 degree position can also be transferred to the other side by turning the sensor about its longitudinal axis. Since the wedge-shaped cuts are provided on only one side, the tilting of sensor head portion 1 relative to signal output portion 2, without clamping the joint axis, can be prevented by loosening and fastening a nut 56 in the vicinity of joint axis 3. As a result of the wedge-shaped cuts, no space is lost for connecting the sensor head portion to the signal output portion, because the full circle for the connecting conductors is preserved. The diameter of the joint circle corresponds to the diameter of the sensor itself. In other words, the sensor head portion and the sensor output portion each have the same diameter.

Figure 36:
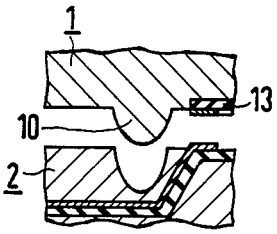
Figure 37:
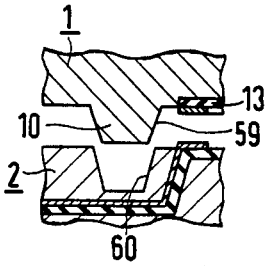
Figure 38:
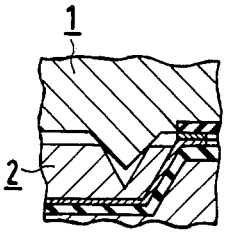
FIGS. 38–40 show detail views of the profiled seals of FIGS. 35–37 after the sensor portions have been brought into communication with one another.
Figure 39:
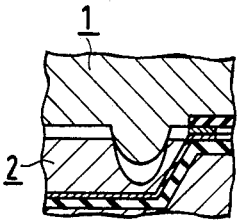
Figure 40:
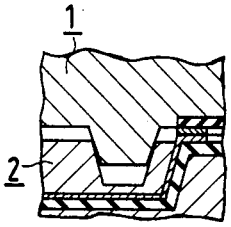

The embodiments of the invention shown in FIGS. 34–42 agree in principle with the embodiments of FIGS. 1–14, particularly FIGS. 10–14. In the embodiments of FIGS. 34–42, however, special profiles are provided for sealing element 10. The circular ring-shaped sealing element at sensor head portion 1, according to FIGS. 34 and 35, has a wedge-shaped cross-section 57. A wedge-shaped recess 58 is provided in signal output portion 2, and has a somewhat more acute wedge angle so that it is pressed together in a manner shown in FIG. 38. When the two sensor portions are joined, the seal is accomplished. FIGS. 36 and 39 show an embodiment wherein sealing element 10 has a semicircular cross-section. The mating recess in the other sensor portion is likewise configured to be somewhat smaller, so that the impression which results from such an engagement corresponds to FIG. 39. FIGS. 37 and 40 show the design of the sealing element utilizing a trapezoidal profile. In this embodiment, the trapezoidal recess is configured to be smaller so that flanks 59 of the trapezoid are pressed against corresponding side walls 60 of the recess.

Figure 41:
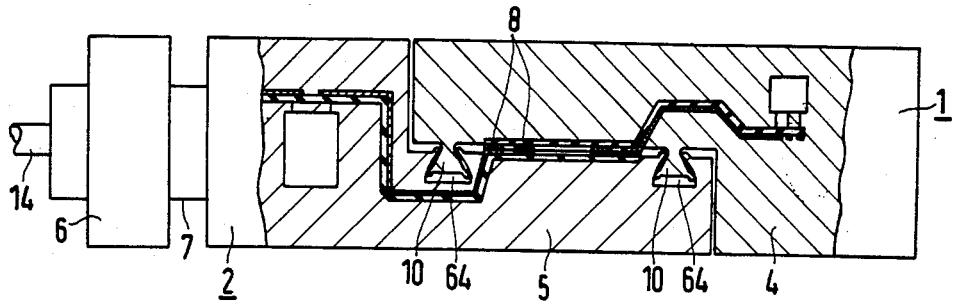
FIG. 41 is a partially cross-sectioned longitudinal view of an arrangement having a dovetail-shaped profiled seal.
Figure 42:
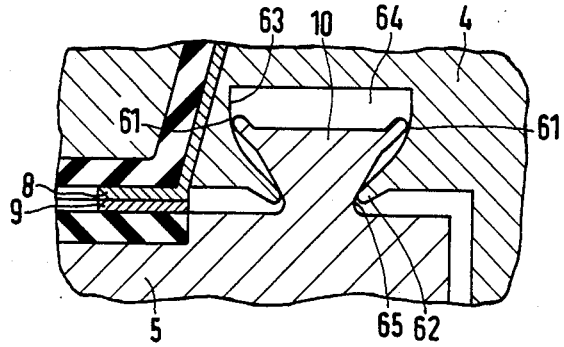
FIG. 42 is a cross-sectional representation of the dovetail-shaped seal of FIG. 41.

In the embodiment of FIGS. 41 and 42, a dovetail-shaped sealing slot is formed at one sensor portion so that it must snap into the other portion. The cross-section of the sealing opening must therefore have a smaller entrance width than the width of the dovetail of the seal. This requires the dovetail seal or the edges of the recess to be elastic such that the dovetail can snap into the recess. In this regard, it is particularly advantageous to provide spring lips 61 on sealing element 10. The spring lips are formed-on and have a trapezoidal cross-section. The edges of the trapezoidal recess for the sealing element are also provided with spring lips 62, as shown in FIG. 42, so that practically a double labyrinth seal is obtained when the members of the seal are engaged. Spring lips 61 rests against an undercut portion 63 of the trapezoidal profile of slot 64. Spring lips 62 form a seal with neck 65 of the trapezoidal sealing element 10. The spring lips are formed in a simple manner when the sensor is foamed-in by integral PU foam. This is achieved by a suitable adjustment of the elasticity in this region. In the present invention, the connecting means in joint axis 3 can optionally be dispensed with. The two sensor portions can be joined together in practice by a snap-in connection which simultaneously forms the seal.

Figure 43:
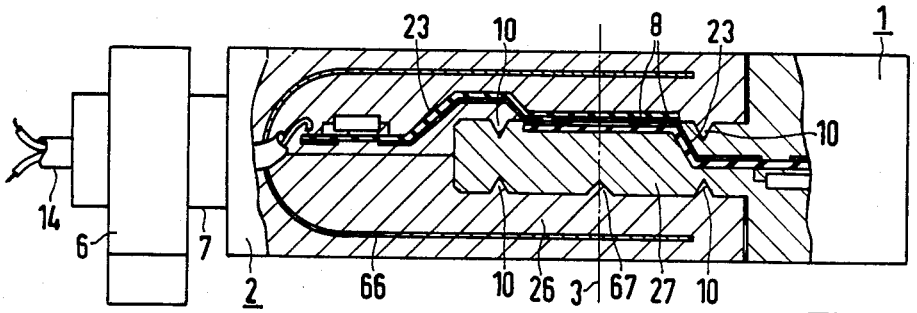
FIGS. 43 and 44 are partially cross-sectioned views of a sensor arrangement having a fork-shaped connecting bracket which provides a foamed-in fork spring in side and top views, respectively.
Figure 44:
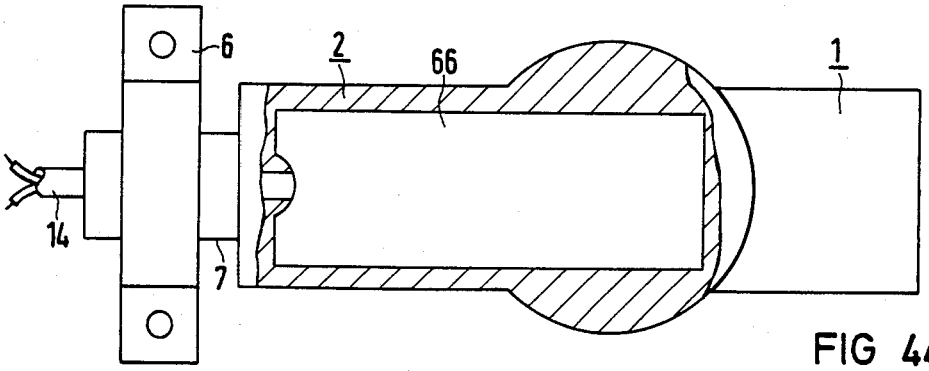

In the embodiment of FIG. 41, the trapezoidal sealing element is arranged at sensor head portion 1 and in the detailed drawing of FIG. 42, at the signal output portion 2. A further possibility for dispensing with special clamping screws or clamping elements which form the joint axis is shown in the embodiment of FIGS. 43 and 44. In this embodiment, a fork-like spring 66, which may be designed as a leaf spring, is foamed in the integral foam into the fork-shaped connecting brackets 26. Thus, the fork tines 26 are pressed into the single connecting bracket 27 via sealing element 10 as well as via circular rings 8 or circular ring segments 9. The conical protrusions 67 can provide the follower action in joint axis 8 if the guidance by sealing element 10 is not deemed to be sufficient.

In accordance with the invention, a simple connection between two or more sensor portions is provided, which can be constructed practically without additional effort using flexible conductor and foaming-in techniques. PU integral foam is preferably used in the foaming-in technique for the reason that no separate insertion of a sealing element is necessary. Thus, the use and manufacture of a sealed sensor arrangement is facilitated. Moreover, this arrangement permits the sensor to be oriented in practically any response direction without the need for special holding means therefor.

Although the invention has been described in terms of specific embodiments and applications, it is to be understood that persons skilled in the art, in light of this teaching, can design additional embodiments without departing from the spirit or exceeding the scope of the claimed invention. Accordingly, it is to be understood that the drawings and descriptions in this disclosure are proffered to facilitate comprehension of the invention and should not be construed to limit the scope thereof.

What is claimed is:

1. A direction-sensitive sensor having a first sensor portion connected to a second sensor portion at a swivel joint, the swivel joint being formed of a bracket connection at which the sensor portions are held in a desired angle of rotation position in a holder which is rotatable about a further axis perpendicular to the axis of the joint, the sensor portions being electrically connected to one another, the arrangement further comprising:

at least portions of circular rings arranged concentrically about the joint axis, said portions of said circular rings being firmly connected to the connecting brackets;

sealing means arranged on at least one of the brackets for enclosing the outermost one of said circular rings;

circuit board means arranged in at least one of said sensor portions;

at least one electrical component arranged on said circuit board; and electrical connecting elements arranged on said circuit board for providing an interconnection between said first and second sensor portions.

2. The direction-sensitive sensor of claim 1 wherein there are further provided conductor runs from said circuit boards, said conductor runs being formed simultaneously with said electrical connecting elements by etching copper laminates.

3. The direction-sensitive sensor of claim 1 wherein there is further provided integral foam encapsulation consisting of a polyurethane synthetic resin, said integral foam encapsulation forming an outer surface for enclosing said electric components, said surface having an elastic portion in at least one of the first and second sensor portions for sealing said electrical connecting elements, said electrical connecting elements protruding above said integral foam surface by an amount which corresponds to a height of said compressed seal.

4. The direction-sensitive sensor of claim 1 wherein there are further provided feed-through conductor run outputs for connecting said electrical connecting elements.

5. The direction-sensitive sensor of claim 4 wherein said circuit board is a flexible circuit board, said electrical connecting elements being formed in the same manner as said feed-through conductor run outputs, said electrical connecting elements being arranged on a section of said circuit board which is offset toward a contact side of the bracket connection and embedded in said integral foam encapsulation.

6. The direction-sensitive sensor of claim 1 wherein one of the first and second sensor portions is provided with at least two brackets in a fork-shaped arrangement, the remaining one of said sensor portions having a single mating bracket for engaging between said fork brackets of said other sensor portion.

7. The direction-sensitive sensor of claim 6 wherein each of the first and second sensor portions is provided with a plurality of connecting brackets with electrical connecting elements and sealing elements.

8. The direction-sensitive sensor of claim 6 wherein at least one of said connecting brackets is provided with a circular rounding for engaging a corresponding circular recess of a further connecting bracket, said engagement being such that said engaged brackets form a centered joint cylinder.

9. The direction-sensitive sensor of claim 1 wherein there is further provided:

inner sealing means for enclosing said circular rings at a radially inward point; and a tightening element arranged radially inward of said inner sealing means for connecting the sensor portions in a form-locking manner.

10. The direction-sensitive sensor of claim 9 wherein said tightening element is formed of a threaded member, and there is further provided a spring element for exerting a resilient force in a direction opposite to a direction of force of said tightening element.

11. The direction-sensitive sensor of claim 9 wherein said tightening element is a coil spring having a spring head of an enlarged diameter at one end thereof, said spring head being disposed in a depression in one of said sensor portions, the other of said sensor portions having an internally threaded portion for threadedly engaging said coil spring.

12. The direction-sensitive sensor of claim 11 wherein said coil spring is formed of spring wire, one end of said spring wire being arranged as a chord across a diameter of said coil spring, said spring wire end being bent backwards in a fork-like fashion to form a screwdriver slot.

13. The direction-sensitive sensor of claim 8 wherein said circular roundings and circular recesses have equal diameters and are selected to be less than the diameter of the sensor portions.

14. The direction-sensitive sensor of claim 13 wherein said sensor portions are configured to have, on at least one side for increasing the circular contour of the rounding and the recess, wedge-shaped cuts which produce plane wedge surfaces which lie adjacent to each other when sensor portions are oriented at an angle with respect to one another.

15. The direction-sensitive sensor of claim 1 wherein said sealing means is provided with a profiled sealing ring which is concentrically arranged about said joint axis, to protrude above a surface of the bracket of one of the sensor portions to engage with a correspondingly shaped profiled sealing slot in the bracket of the other sensor portion, in a form-locking manner.

16. The direction-sensitive sensor of claim 15 wherein said profiled sealing ring has a wedge-shaped cross-section having inclined surfaces and a profile which corresponds to a wedge form with a narrow cross-section for adapting to deformation of said seal.

17. The direction-sensitive sensor of claim 15 wherein said profiled sealing ring and said profiled sealing slot are formed of integral PU foam, at least one of said sealing elements being formed of elastic integral PU foam.

18. The direction-sensitive sensor of claim 17 wherein said profiled sealing ring and said profiled sealing slot are each provided with a cross-sectional configuration having an undercut, dovetail-like profile, said sensor portions and said circular rings being brought into contact with one another by a snap-in engagement.

19. The direction-sensitive sensor of claim 18 wherein said profiled sealing ring is provided, in the vicinity of said undercut, with spring lips which extend beyond the contours of the profiled sealing slot, with pretension so as to generate a contact pressure for the electrical connecting elements, and for the seal.

20. The direction-sensitive sensor of claim 6 wherein there is further provided an inward, pretensioned leaf spring embedded in the outer connecting brackets of said fork system.

21. The direction-sensitive sensor of claim 20 wherein there is further provided a conical rise on at least one of said connecting brackets for engaging a depression on the other of said connecting brackets in a form-locking manner.

22. The direction-sensitive sensor of claim 1 wherein said first and second sensor portions are provided on their respective exteriors with a screw thread.

23. The direction-sensitive sensor of claim 1 wherein said sensor portions are formed of a sensor head portion and a sensor output portion, respectively.

* * * * *